United States Patent [19]

Palmer

[11] Patent Number: 4,737,101

[45] Date of Patent: Apr. 12, 1988

[54] OIL BURNER

[75] Inventor: Michael F. Palmer, Poole, United Kingdom

[73] Assignee: Davair Heating Limited, Poole, England

[21] Appl. No.: 881,188

[22] Filed: Jul. 2, 1986

Related U.S. Application Data

[63] Continuation of Ser. No. 707,516, Mar. 4, 1985, abandoned.

[51] Int. Cl.[4] ..... F23N 1/00

[52] U.S. Cl. ..... 431/12; 126/351

[58] Field of Search ..... 126/360 R, 351, 367, 126/376, 380, 301; 431/12, 354, 76; 236/20 R

[56] References Cited

U.S. PATENT DOCUMENTS

| | | | |
|---|---|---|---|
| 2,289,047 | 7/1942 | Russel | 236/1 |
| 2,410,548 | 11/1946 | McCollum | 431/328 |
| 3,199,568 | 8/1965 | Baumanns et al. | 431/328 |
| 3,861,855 | 1/1975 | Seider | 431/76 |
| 3,890,936 | 6/1975 | Mcherney et al. | 126/351 |
| 4,315,730 | 2/1982 | Watson | 431/76 |
| 4,330,260 | 7/1982 | Jogensen et al. | 431/76 |
| 4,375,950 | 3/1983 | Durley III | 431/76 |
| 4,406,611 | 9/1983 | Michel | 431/12 |

FOREIGN PATENT DOCUMENTS

| | | | |
|---|---|---|---|
| 1112620 | 8/1961 | Fed. Rep. of Germany . | |
| 0055616 | 4/1983 | Japan | 431/76 |
| 0074426 | 4/1983 | Japan | 431/76 |
| 0069322 | 4/1983 | Japan | 431/76 |
| 2,075718 | 9/1984 | United Kingdom . | |

*Primary Examiner*—Samuel Scott
*Assistant Examiner*—H. A. Odar
*Attorney, Agent, or Firm*—Lee, Smith & Zickert

[57] ABSTRACT

An oil burner of the air atomizing or vaporizing pot type has means to supply oil and combustion air to a combustion chamber adjacent a fluid chamber which receives heat therefrom. Heated fluid is removed from and cooler fluid supplied to the fluid chamber. Control means operate to vary the supply of air and oil dependent on the temperature of the heated fluid leaving the fluid chamber or on the temperature difference between the heated fluid and the cooler fluid.

8 Claims, 3 Drawing Sheets

OIL BURNER

This application is a continuation of U.S. patent application Ser. No. 707,516, filed Mar. 4, 1985 and now abandoned.

FIELD OF THE INVENTION

This invention relates to oil burners and is particularly concerned with burners of the air atomising type.

BACKGROUND OF THE INVENTION

Until recently pressure jet oil burners have proved successful owing to their satisfactory performance and reasonable price. However recent years have seen a change in the standard fuel oils being produced by the oil companies, as a result of many factors, such as the wider diversity of oil sources in the world and changes in the needs of industry for various petroleum-based products. Until recently, light oils (kerosene and gas oil) were produced to the lower tolerance of the specified standard for fuel oils, giving oils which operated in existing pressure jet oil burners with good atomisation. Today the light oils are produced nearer to the upper specified density and viscosity tolerance of the standard for fuel oils. When such oils are used in pressure jet oil burners, problems have arisen due to poor atomisation and bad starting especially at low ambient temperatures. Pressure jet burner manufacturers have suggested that these problems can be overcome by fitting heaters to the oil nozzle assembly. The fine tolerance and small apertures within the nozzles of such burners have led to the need for high degrees of filtration of the oil supply and this has caused problems due to the presence of wax constituents within the oils. Thus, because of the danger of waxing in cold weather, the oil industry has suggested that industrial and domestic installations need to include storage tank heaters and pipework insulation. Naturally, these additional provisions increase the cost of installating oil fired equipment.

There is clearly a need for the development of alternative burners which have a wider operating tolerance and can perform satisfactorily with the fuel oils now available.

OBJECTS OF THE INVENTION

It is an object of the present invention to provide an oil burner which has a wide range of usefulness and is capable of efficient operation with the fuels at present available and likely to be available in the foreseeable future. It is a further object of the invention to provide an oil burner which can perform efficiently over a wide range of fuel flow rates and which can respond rapidly to changing requirements. These and other objects of the invention will become apparent from the following description and claims.

SUMMARY OF THE INVENTION

According to this invention we provide an oil burner of the air atomising or vaporising pot type comprising a combustion chamber provided with means for the supply of oil and means for the supply of combustion air, a fluid chamber adjacent the combustion chamber and arranged to receive heat therefrom, means for removing heated fluid from the fluid chamber and introducing cooler fluid thereto, and control means whereby the supply of air and oil is varied dependent on the temperature of the heated fluid leaving the fluid chamber or on the temperature difference between heated fluid leaving the fluid chamber and cooler fluid introduced thereto. The fluid may be water or air and the burner may form part of a boiler or space heater.

According to one form of the invention the burner is of the air atomising type and the combustion chamber is fitted with an oil/air jet nozzle having an oil orifice surrounded by outer air outlet means. Alternatively the burner may be of the vaporizing pot type.

Preferably the control means comprises a motor speed controller which controls the speed of a burner motor dependent on said temperature or said temperature difference. The burner motor suitably controls the pressure of the oil and/or (for an air atomising burner) the pressure of the atomising air and suitably also controls the supply of combustion air to the combustion chamber.

BRIEF DESCRIPTION OF THE DRAWINGS

Two forms of the invention will now be described by way of example with reference to the accompanying drawings, wherein.

DESCRIPTION WITH REFERENCE TO THE DRAWINGS

Figure 1:
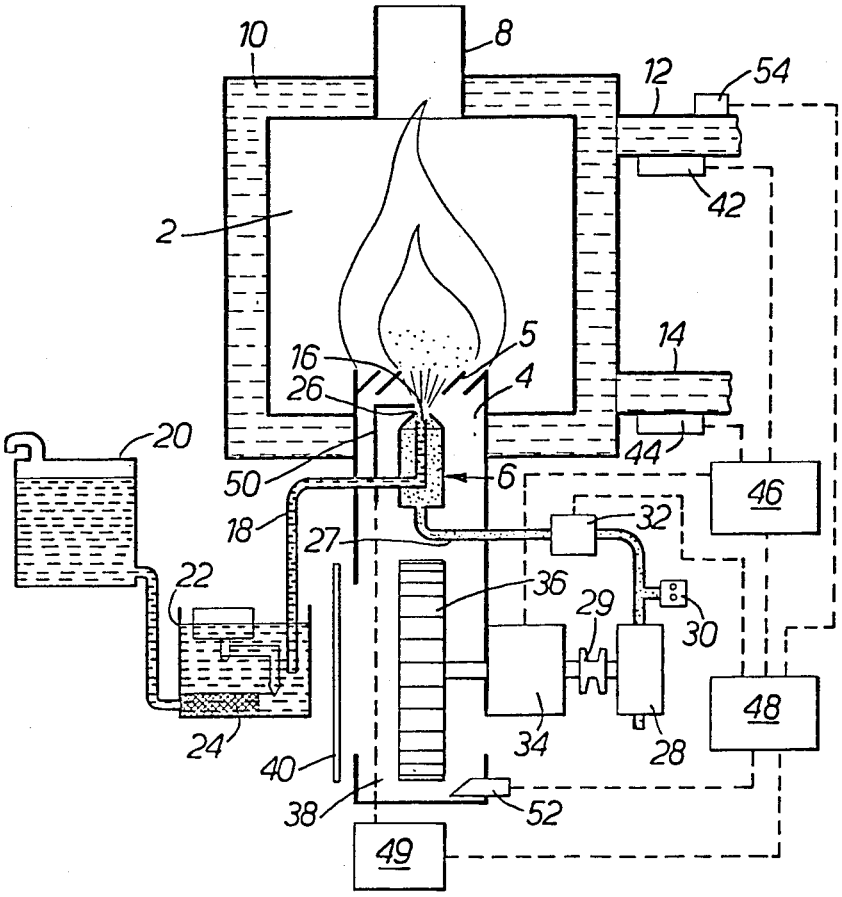
FIG. 1 is a diagrammatic representation of an oil burner of the air atomising type intended for low output uses.

Referring to FIG. 1, the burner comprises a combustion chamber 2 having at the bottom an aperture 4, fitted with a flame ring 5, within which is mounted an oil/air jet nozzle 6, and at the top a flue 8. Around combustion chamber 2 is a low capacity water boiler 10 having an outflow 12 for heated water and a return 14 for returned cooler water which has given out its heat, for example to domestic radiators.

Oil/air jet nozzle 6 comprises a central oil supply orifice 16 fed by suction oil line 18. Oil from a main storage tank 20 reaches orifice 16 via a float tank 22 fitted with a coarse mesh filter 24. Oil is sucked from float tank 22 to nozzle 6 when compressed air is passed over the outer edge of orifice 16 causing a low pressure zone. As air pressure increases, so oil flow increases. If the feedstock fuel oil is relatively heavy, the float tank 22 may be fitted with heating means.

Compressed air is supplied to nozzle 6 via orifice 26 which surrounds oil orifice 16. Compressed air is supplied on line 27 by rotary compressor 28 via pressure relief valve 30 and magnetic solenoid valve 32. The solenoid valve 32 remains closed until the initial required air purge for start-up is complete. The pressure relief valve 30 stops a build up of air pressure behind the solenoid valve 32 over the pre-purge period.

The air pressure produced by compressor 28 is controlled by a burner motor 34 which drives the compressor 28. The compressor 28 and burner motor 34 are connected via a breakable coupling 29 which will break on malfunction of compressor 28. This burner motor also drives a fan 36 which operates in a chamber 38 communicating with aperture 4. Chamber 38 has adjustable air inlet means 40. Fan 36 thus provides a source of combustion air for the fuel exiting nozzle 6.

Attached to out-flow 12 and return 14 of boiler 10 are temperature sensors 42 and 44 respectively. A motor speed controller 46 linked to electrical control box 48 receives signals from sensors 42 and 44 and drives burner motor 34 dependent on the difference in temperature between the out-flow 12 and return 14. This difference is indicative of the quantity of heat removed from the water during use for heating. If this quantity is high, this is an indication that the ambient temperature is low. However, controller 46 is arranged so that with increasing temperature differential, motor 34 is caused to speed up, thus increasing the atomising air pressure, increasing oil flow and increasing the supply of combustion air to the burner head. With decreasing temperature differential the controller 46 causes a decrease in motor speed with resultant decrease in atomising air pressure, oil flow and supply of combustion air.

In an alternative form of the invention, controller 46 can operate dependent on the temperature at the outflow 12 in response to sensor 42 only. Thus if the outflow temperature is low, controller 46 will speed up motor 34 and vice versa.

The apparatus may incorporate conventional features of such air atomising burners. The electrical control box 48 may control not only motor speed controller 46 and burner motor 34, but also transformer 49 connected to ignition means 50 and photocell 52 for detecting the presence of a flame within the combustion chamber. Safety features such as an overheat cut-off device 54 may be incorporated to prevent boiling of the water or a combustion chamber pressure alarm (not shown) to warn when the boiler needs cleaning.

It will be appreciated that variations in the arrangement shown can be employed within the scope of the invention. Thus for example solenoid 32 may be positioned not in the compressed air line 27 but in the oil line 18.

The burner as described above can operate over its range with substantially unchanged combustion characteristics and high efficiency at low load can be maintained. The accurate control of water temperature means that a low water capacity boiler can be used.

Figure 2:
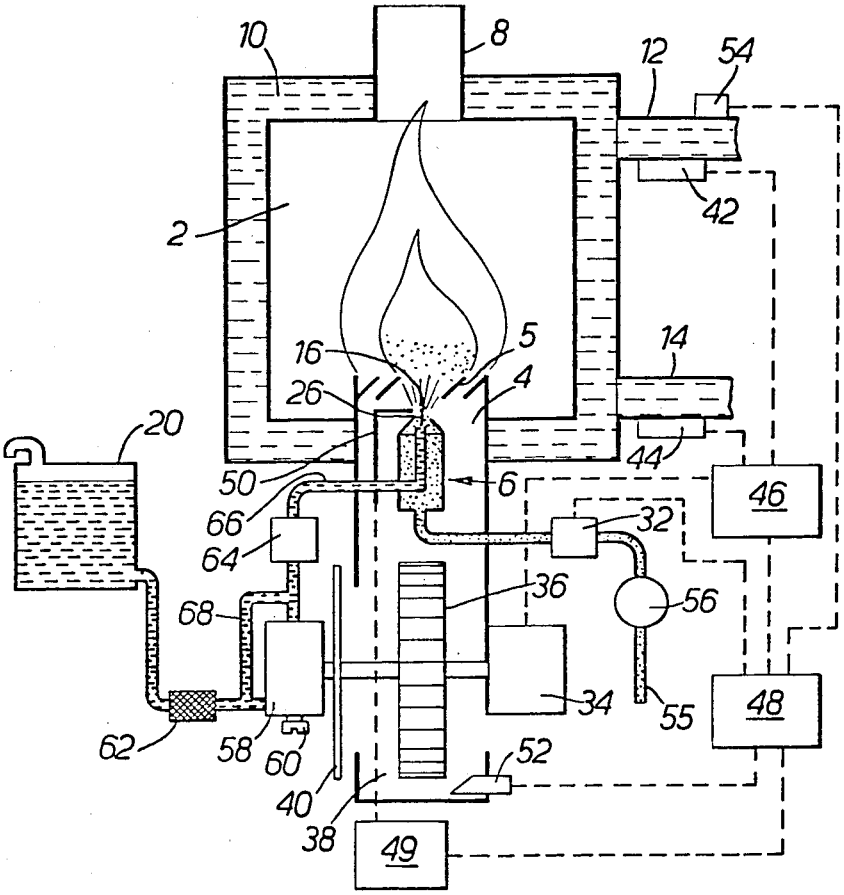
FIG. 2 is a diagrammatic representation of an oil burner of the air atomising type intended for high output uses.
Figure 3:
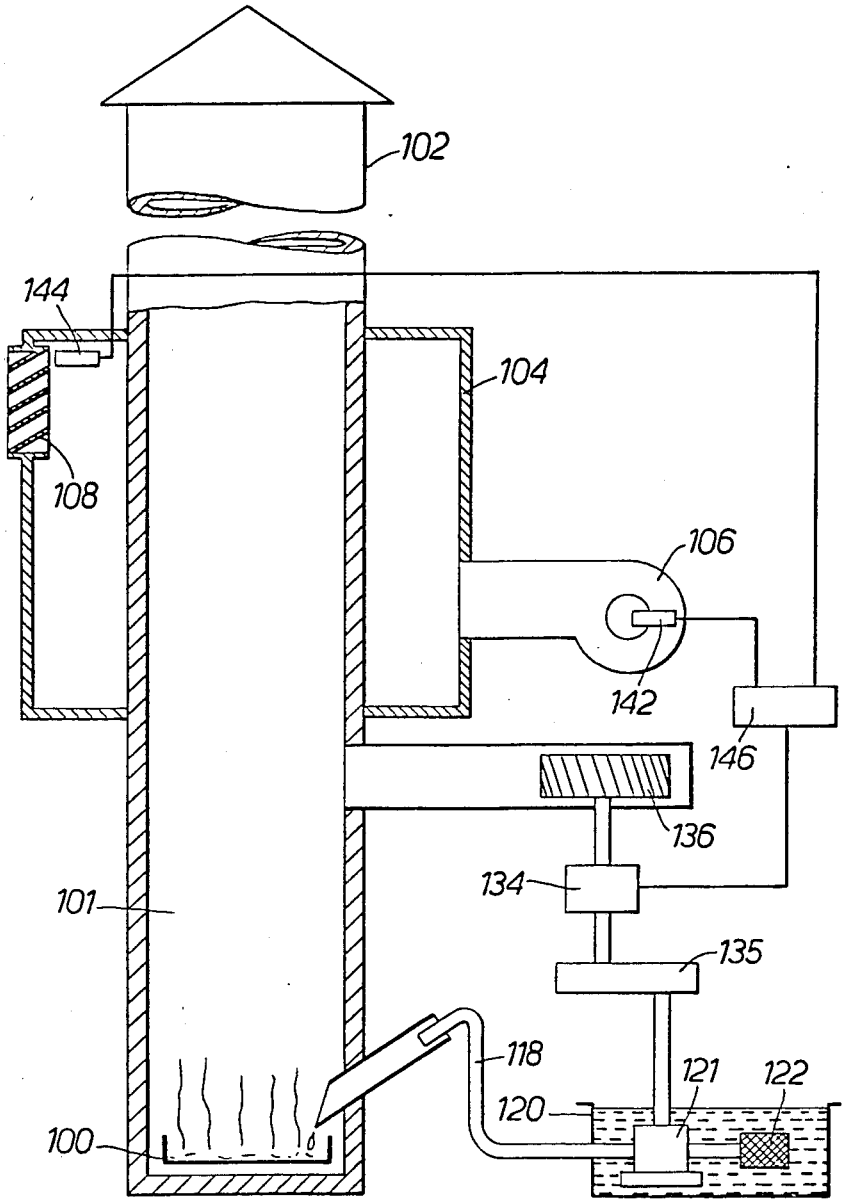

FIG. 2 shows a burner similar to that shown in FIG. 1 but adapted for high output. Similar parts in FIGS. 1 and 2 have been given the same reference numerals. However the air compressor 28 and pressure release valve 30 of FIG. 1 have been replaced by a separate air compressor (not shown) feeding pressurised air on line 55 to a filter air pressure regulator valve 56 upstream of solenoid valve 32. Valve 56 is pre-set at a constant pressure suitable for a wide range of temperatures and oils. Alternatively the atomising air pressure may be controlled from controller 46. The oil float tank 22 of FIG. 1 has been replaced by a low pressure oil pump 58 fitted with an oil pressure adjustment device 60. Pump 58 is fed from tank 20 via a mesh filter 62 and thence to orifice 16 via oil solenoid valve 64 and line 66. A bypass 68 is provided to ensure no excessive increase in oil pressure behind the solenoid valve whilst the combustion chamber pre-purge sequence is in operation. If heavier fuel oils are employed an oil preheating chamber may be incorporated. It will be noted that the low pressure pump 58 is actuated by the burner motor 34 so that the amounts of oil and combustion air reaching the combustion chamber 2 are again controlled by controller 46.

Burners such as those described above can operate with, for example, feedstock oils of viscosities of 1.6 to over 30 centistokes. It is possible to modulate the burner during operation with very little change in combustion characteristics and with the maintenance of high efficiency at low loading.

It will be appreciated that the direct control of the oil and air supply as a result of the measured temperature differential gives a speedy reaction to changing external requirements. Thus, for example, the burner in accordance with the invention, if employed in a domestic central heating system, will rapidly respond to the opening or closing of individual radiator valves.

We have also found that the burner of the invention will rapidly reach the required fuel rate on ignition, for example in 60 seconds, from switch on, as compared to a comparatively slow stabilizing period of perhaps 20 minutes for pressure jet burners. Further, the fuel flow rate through the burner nozzles can be controlled to within ±2% of the stated flow and the type of fuel used can vary in density and viscosity without adversely affecting performance. Because the nozzle passages of an air atomising burner are less fine than those of a pressure jet burner, relatively coarse filtering of the fuel gives a satisfactory domestic grade fuel for the nozzle in cold conditions without storage tank heating.

In addition we have found the combustion characteristics of the burners of the invention to be good giving clean operation with a wide range of fuels. We have found that the burners can operate from, for example 200,000 Btus/hour down to low flow rates of 20,000 or even 10,000 Btus/hour. As high pump pressures are not required for fuel atomisation low speed motors can be employed giving comparatively quiet operation.

What is claimed is:

1. In an oil burner of the air atomising type comprising a combustion chamber provided with means for the supply of atomised oil and means for the supply of combustion air, a fluid chamber surrounding the combustion chamber and arranged to receive heat therefrom and means for removing heated fluid from the fluid chamber and introducing cooler fluid thereto, the improvement comprising a variable speed burner motor for controlling the supply of both oil and combustion air, means for measuring the temperature of the heated fluid leaving the fluid chamber or the temperature difference between heated fluid leaving the fluid chamber and cooler fluid introduced thereto, and a motor speed controller, operatively connected to the burner motor and independent of the composition of the products of combustion in the combustion chamber adapted to receive signals indicative of the measured temperature or temperature difference and vary the speed of the burner motor responsive thereto, whereby the supply of both combustion air and oil is varied dependent only on said temperature or temperture difference, while maintaining substantially unchanged combustion characteristics over the entire output range of the burner.

2. The oil burner of claim 1, wherein said motor speed controller receives signals so that the supply of combustion air and oil is varied dependent on the temperature different between heated fluid leaving the fluid chamber and cooler fluid introduced thereto.

3. The oil burner of claim 1, wherein the means for the supply of oil comprises an oil supply line and the burner motor is connected to means to control the pressure in the oil supply line.

4. The oil burner of claim 1 including a compressor for supplying atomising air to said means for supply of atomised air and in which the burner motor controls the supply of oil by being connected to and controlling the operation of the compressor.

5. The oil burner of claim 4, including a frangible coupling linking the compressor and the burner motor.

6. The oil burner of claim 1, including temperature sensors provided to measure the temperature of the fluid leaving the fluid chamber and/or introduced thereto, said sensors being linked to said motor speed controller.

7. The oil burner of claim 1, wherein the fluid is water and the oil burner forms part of a boiler.

8. The oil burner of claim 1, wherein the fluid is air and the burner forms part of a space heater.

* * * * *